US008127830B2

(12) United States Patent
Lee et al.

(10) Patent No.: US 8,127,830 B2
(45) Date of Patent: Mar. 6, 2012

(54) AIR CONDITIONER

(75) Inventors: Jung Woo Lee, Seoul (KR); Kyung Hwa Park, Seoul (KR); Seok Ho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 1221 days.

(21) Appl. No.: 11/845,363

(22) Filed: Aug. 27, 2007

(65) Prior Publication Data

US 2008/0047697 A1 Feb. 28, 2008

(30) Foreign Application Priority Data

Aug. 28, 2006 (KR) ..... 10-2006-0081546

(51) Int. Cl.
*F25B 17/00* (2006.01)

(52) U.S. Cl. ..... 165/122; 165/139; 62/410

(58) Field of Classification Search ..... 165/122, 165/124, 125; 62/262, 409, 410
See application file for complete search history.

(56) References Cited

U.S. PATENT DOCUMENTS

| | | | | |
|---|---|---|---|---|
| 1,838,505 | A * | 12/1931 | Shurtleff | 165/100 |
| 2,405,411 | A * | 8/1946 | Dybvig | 62/89 |
| 3,165,053 | A * | 1/1965 | Christie | 454/202 |
| 3,975,920 | A * | 8/1976 | McCauley et al. | 62/262 |
| 5,117,653 | A * | 6/1992 | Kil | 62/291 |
| 6,443,832 | B1 * | 9/2002 | de Barros et al. | 454/202 |
| 2003/0042010 | A1 * | 3/2003 | Kobayashi et al. | 165/122 |
| 2006/0191279 | A1 | 8/2006 | Hong et al. | |
| 2006/0213212 | A1 | 9/2006 | Hong et al. | |
| 2007/0137243 | A1 | 6/2007 | Lee et al. | |

FOREIGN PATENT DOCUMENTS

| | | | |
|---|---|---|---|
| EP | 0 791 788 | A2 | 8/1997 |
| EP | 1 486 736 | A2 | 12/2004 |
| GB | 2 314 924 | A | 1/1998 |
| JP | 63-254334 | A | 10/1988 |
| KR | 20-0241498 | | 9/2001 |

OTHER PUBLICATIONS

U.S. Appl. No. 11/836,395 to Choi et al., which was filed Aug. 9, 2007.

* cited by examiner

*Primary Examiner* — Allen Flanigan
(74) *Attorney, Agent, or Firm* — McKenna Long & Aldridge LLP

(57) ABSTRACT

An air conditioner is disclosed which includes a case including an external air inlet opening formed in a side of the case, a heat exchanger provided in the case, and a guide part which guides external air which enters the case through the external air inlet opening into an interior of the heat exchanger.

9 Claims, 2 Drawing Sheets

【Figure 1】
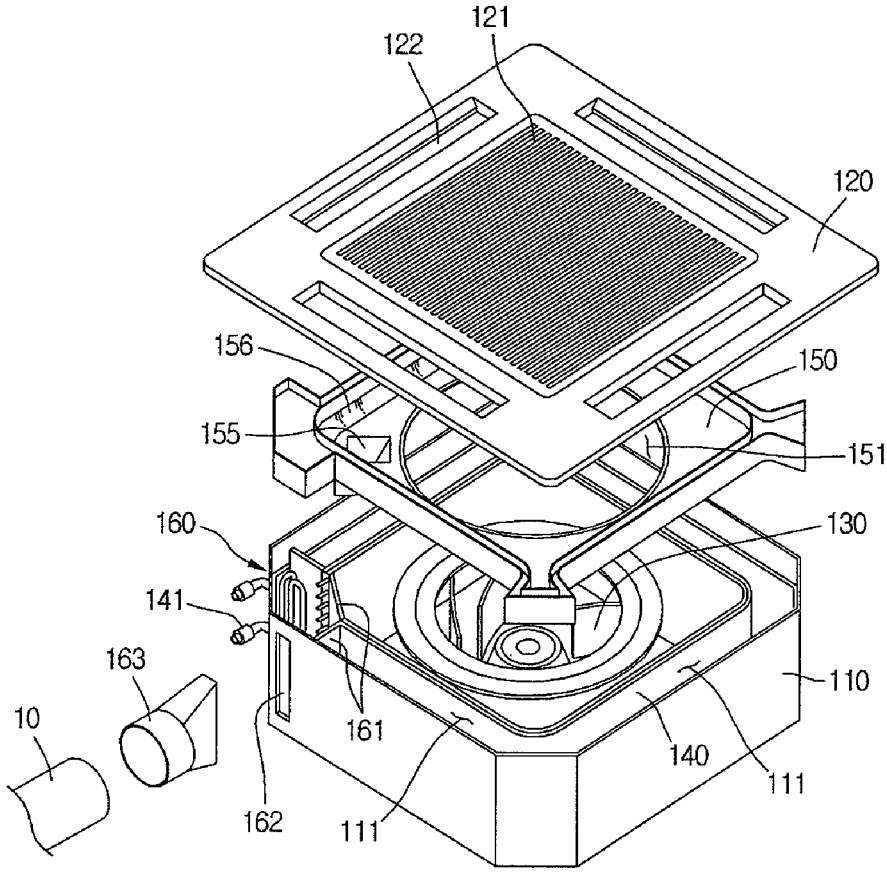
【Figure 2】
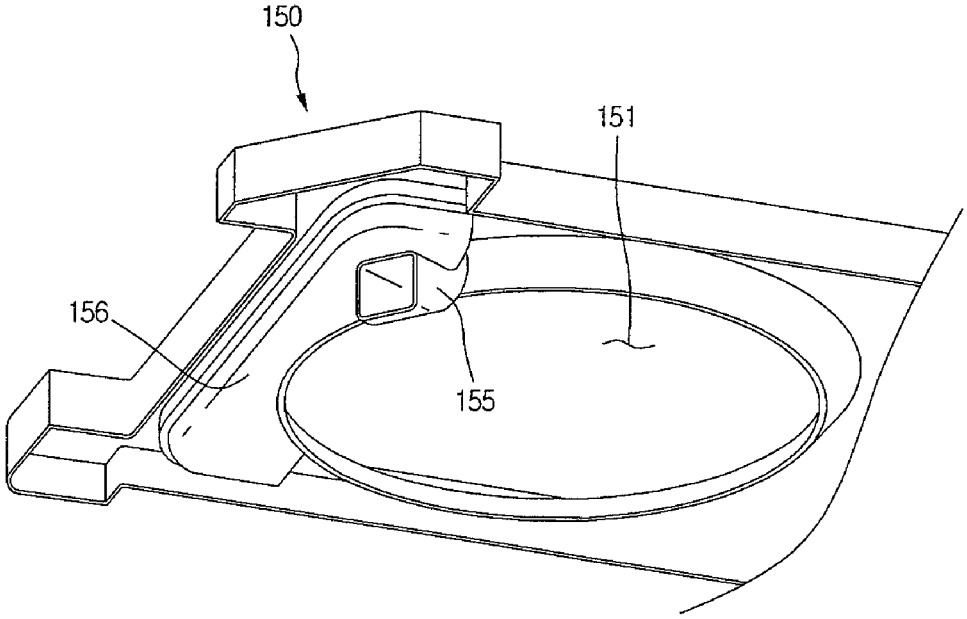

【Figure 3】
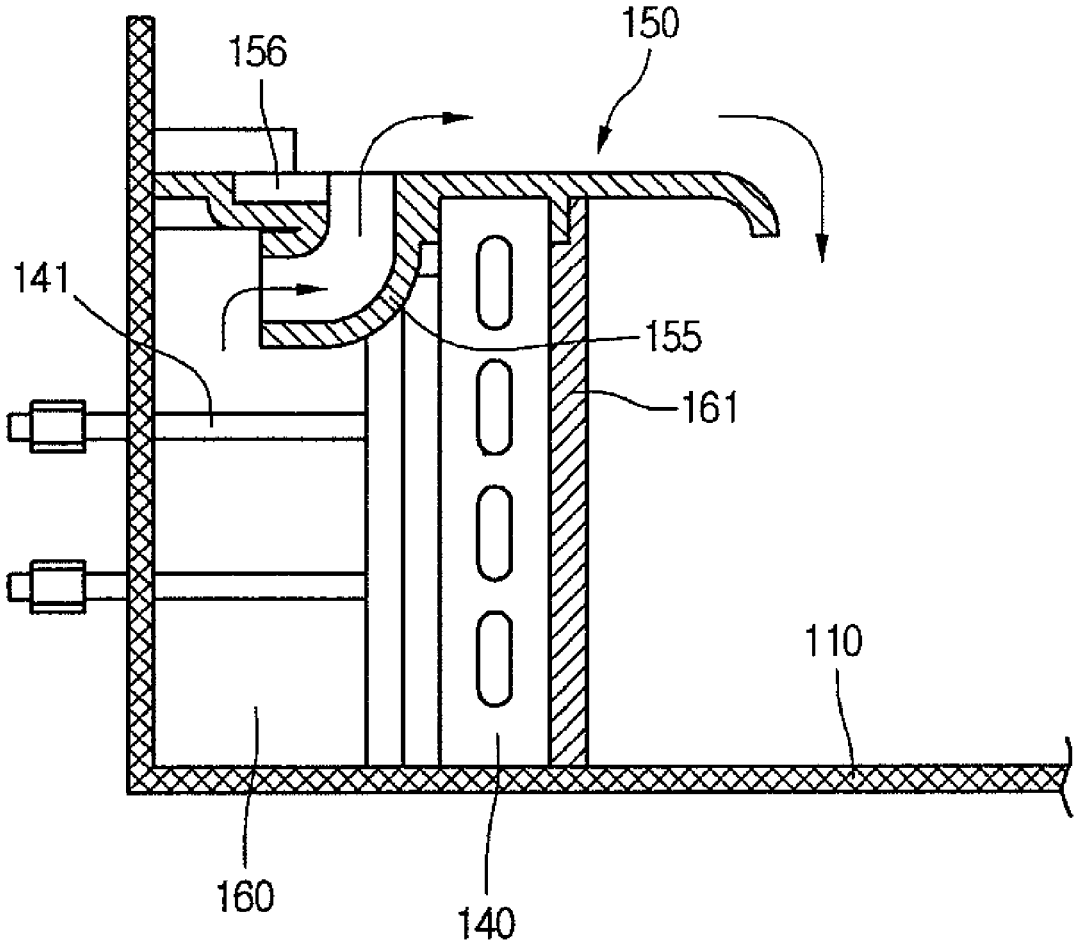

AIR CONDITIONER

This application claims the benefit of Korean Application No. 10-2006-0081546, filed on Aug. 28, 2006, which is hereby incorporated by reference in its entirety.

BACKGROUND

The present disclosure relates to an air conditioner.

In general, an air conditioner is an apparatus that ventilates and/or warms or cools an indoor space. A ceiling mounted air conditioner is a type of air conditioner with an indoor unit installed in a ceiling. A ceiling mounted air conditioner includes a heat exchanger surrounding a fan. An external air supplying duct of a ceiling mounted air conditioner is either directly connected on the indoor unit or connected thereto using a separate connecting kit.

However, in cases where the external air supplying duct is directly connected on the indoor unit, because the heat exchanger is disposed to enclose the fan, the external air inlet part must pass over the heat exchanger, which necessitates that an external air inlet part be formed with a narrow breadth. Moreover, in buildings with low ceilings, it is difficult to install and apply an external air inlet part. Thus, the external air inlet part according to the related art are insufficient for providing an adequate amount of air to condition an indoor space.

Also, in the case where the external air inlet part is connected to an indoor unit through a separate connecting kit, because the heat exchanger encloses the fan, the connecting kit must be coupled to an entrance between the body of the unit and its front panel. In this case, the installation height of the indoor unit must be increased by the breadth of the connecting kit, so that the structure cannot be applied to buildings with low ceilings.

SUMMARY

One of the features of the present invention is an air conditioner that sufficiently increases an external air inlet part without increasing the installation height of the air conditioner.

Another feature is an air conditioner that can be applied to buildings with low ceilings.

Another feature is an air conditioner that can ventilate an indoor space without adding a separate ventilation fan.

Disclosed is an air conditioner which includes a case including an external air inlet opening formed in a side of the case, a heat exchanger provided in the case, and a guide part which guides external air which enters the case through the external air inlet opening into an interior of the heat exchanger.

The air conditioner may include a front panel which covers the case, and the guide part may be provided between the heat exchanger and the front panel. The guide part may include an air inlet which guides interior air into the interior of the heat exchanger.

The air conditioner may include an external air inlet chamber, provided in the case outside a periphery of the heat exchanger, into which external air enters through the external air inlet opening. The air conditioner may also include an air outlet passage formed between the heat exchanger and the case, and at least one partition which defines the external air inlet chamber and separates the external air inlet chamber from the air outlet passage. The air conditioner may also include a refrigerant pipe connector which couples to a refrigerant pipe and passes through the external air inlet chamber.

The guide part may include an air inlet which guides interior air into the interior of the heat exchanger, and a connecting channel through which external air passes from the external air inlet chamber to the air inlet. The connecting channel may be located outside a periphery of the heat exchanger. The guide part may include a guiding groove through which external air passes from the connecting channel to the air inlet. The air conditioner may include a front panel which covers the case, and the guide groove may be recessed in a direction away from the front panel. The connecting channel may enter a top of the external air inlet chamber. The air conditioner may include a fan which sucks interior air and the external air into the interior of the heat exchanger.

The details of one or more embodiments are set forth in the accompanying drawings and the description below. Other features will be apparent from the description and drawings, and from the claims.

BRIEF DESCRIPTION OF THE DRAWINGS

FIG. 1 is an exploded perspective view of an air conditioner according to the present disclosure.

FIG. 2 is a perspective view of a connecting channel of the air conditioner in FIG. 1.

FIG. 3 is a sectional view of an external air inlet chamber of the air conditioner in FIG. 1.

DETAILED DESCRIPTION OF THE EMBODIMENTS

Reference will now be made in detail to the embodiments of the present disclosure, examples of which are illustrated in the accompanying drawings.

FIG. 1 is an exploded perspective view of an air conditioner according to the present disclosure.

Referring to FIG. 1, a front panel 120 is disposed on the case 110 of the air conditioner. An intake grill 121 for suctioning air from an indoor space into the case 110 is formed on the front panel 120. An air outlet 122 is formed around the perimeter of the intake grill 121 to discharge air into the indoor space. A louver (not shown), for adjusting the discharged direction of air, is formed on the air outlet 122.

A fan 130 is provided within the case 110. The fan 130 used may be a centrifugal fan 130 that suctions air in an axial direction thereof, and discharges air in a radial direction. The fan is rotated by a motor (not shown).

A heat exchanger 140 is disposed around the perimeter of the fan 130. The heat exchanger 140 is bent in an approximately rectangular or ring shape.

An air outlet passage is formed around the outside of the heat exchanger 140 to correspond to the air outlet 122 of the front panel 120.

A guide part 150 is disposed between the fan 130 and the front panel 120. An air inlet 151 for guiding air suctioned by the fan 130 is formed in the guide part 150. The guide part 150 may be mounted against a side (the upper end in FIG. 1) of the heat exchanger 140.

An external air inlet chamber 160 is defined by a partition 161 on either side thereof. Thus, the external air inlet chamber 160 is partitioned from the air outlet passage of the heat exchanger 140.

The external air inlet chamber 160 may be disposed at the edge of the case 110. Here, a refrigerant pipe connector 141 of the heat exchanger 140 is bent at a right angle such that it is disposed at an edge of the case 110. In this instance, the corner of the case 110 with the least amount of air circulation may be used to form the external air inlet chamber 160. Thus, through forming a space through which external air can flow into the case 110, the suctioning or discharging ability of the air conditioner is not reduced.

The refrigerant pipe connector 141 of the heat exchanger 140 passes through the external air inlet chamber 160. The refrigerant pipe connector 141 facilitates the coupling of an external refrigerant pipe. The refrigerant pipe connector 141 is either housed within the external air inlet chamber 160 or is exposed outside of the external air inlet chamber 160.

An external air inlet part hole 162 for allowing air from the outside to enter is formed in the external air inlet chamber 160. The external air inlet part hole 162 is connected to a connecting duct 163. the connecting duct 163 is connected to an external air supplying duct 10.

The external air inlet chamber 160 communicates with the air passage formed in the case 110. Here, the external air inlet chamber 160 may communicate with the air inlet 151 of the fan 130. Also, the external air inlet chamber 160 may communicate with an air passage to the outside of the heat exchanger (or the top of the air outlet passage 111).

FIG. 2 is a perspective view of a connecting channel of the air conditioner in FIG. 1, and FIG. 3 is a sectional view of an external air inlet chamber of the air conditioner in FIG. 1.

Referring to FIGS. 2 and 3, the structure in which the external air inlet chamber 160 communicates with the air passage will be described.

A connecting channel 155 for connecting the external air inlet chamber 160 and the air inlet 151 of the guide part 150 is formed in the guide part 150. Here, the connecting channel 155 is disposed to the outside of the heat exchanger 140 (or in the air outlet passage 111). A guiding groove 156 connected to the connecting channel 155 is formed in the guide part 150. The guiding groove 156 is for enlarging the space for external air to pass smoothly from the connecting channel 155 to the air inlet 151.

The connecting channel 155 is formed to the outside of the heat exchanger 140 at the guide part 150 partitioning the external air inlet chamber 160 and the air inlet 151, so that a structure for allowing air to enter does not need to be installed on a side (upper end in FIG. 1) of the heat exchanger 140. Thus, even if the height of the case 110 is not increased, air can be sufficiently supplied to the inner space.

Also, the connecting channel 155 communicates with the air inlet 151 of the fan 130, so that the suctioning force of the fan 130 can suction external air. Accordingly, there is no need to install a separate ventilating fan to suction external air through an air supplying duct 10. Also, because the external air inlet chamber 160 communicates with the air inlet 151 of the guide part 150, the external air that enters the air inlet 151 mixes sufficiently with indoor air and sufficiently exchanges heat with the heat exchanger before being discharged to the indoor space.

Furthermore, by forming a communicating hole in the guide part 150, the external air inlet chamber 160 can communicate with the air inlet 151 of the guide part 150.

The above-structured air conditioner according to the present disclosure will be described in terms of its function.

The air conditioner may be operated in cooling or heating mode according to the circulating direction of refrigerant. Here, the air conditioner can operate in cooling or heating mode, together with ventilating mode. The description below will be of only the air conditioner operating simultaneously in cooling mode and ventilating mode.

When the air conditioner is operated in cooling mode, expanded refrigerant is supplied to the heat exchanger 140, and the fan 130 is rotated.

The fan 130 imparts suctioning force, whereby the indoor air is suctioned into the case 110. Here, the air inlet 151 of the guide part 150 guides the suctioning of indoor air smoothly in an axial direction of the fan 130.

The fan 130 also imparts suctioning force on to the space of the external air inlet chamber 160, so that the external air of the air supplying duct is suctioned into the external air inlet chamber 160. The external air that is suctioned through the external air inlet chamber 160 passes through the connecting channel 155, and enters the air inlet 151 of the guide part 150. Here, the guiding groove 156 is recessed in a direction opposite to the front panel 120, so that there is sufficient room for external air suctioned through the connecting channel 155 to flow smoothly.

The thus suctioned indoor air and external air is mixed while being suctioned in an axial direction of the fan 130. The air that is suctioned in the axial direction of the fan 130 is discharged in a radial direction of the fan 130 and cools as it passes through the heat exchanger 140. The air that passes through the heat exchanger 140 reaches the air outlet passage formed at the outside of the heat exchanger 140. The air in the air outlet passage passes through the air outlet 122 of the front cover and is discharged into the indoor space. Accordingly, the indoor space is simultaneously cooled and ventilated by cooled indoor air and external air.

When the air conditioner is set in only ventilating mode, the fan 130 is rotated as above; however, the refrigerant is not supplied to the heat exchanger 140. Here, the indoor air and the external air are not cooled, but are simply discharged into the indoor space.

To avoid increasing the height of the case, the present disclosure increases the size of the external air inlet part to sufficiently ventilate an indoor space, allow installation of the air conditioner in buildings with low ceilings, and avoid having to install a separate ventilating fan.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. An air conditioner, comprising:

a case comprising an external air inlet opening formed in a side of the case;

a heat exchanger provided in the case; and an external air inlet chamber, provided in the case, into which external air enters through the external air inlet opening;

a guide part which guides external air which enters the case through the external air inlet opening into an interior of the heat exchanger, the guide part comprising:

an air inlet which guides interior air into the interior of the heat exchanger;

a connecting channel through which external air passes from the external air inlet chamber to the air inlet; and a guiding groove through which external air passes from the connecting channel to the air inlet.

2. The air conditioner according to claim 1, further comprising a front panel which covers the case, wherein the guide part is provided between the heat exchanger and the front panel.

3. The air conditioner according to claim 1, further comprising an air outlet passage formed between the heat exchanger and the case, and at least one partition which defines the external air inlet chamber and separates the external air inlet chamber from the air outlet passage.

4. The air conditioner according to claim 1, further comprising a refrigerant pipe connector which couples to a refrigerant pipe and passes through the external air inlet chamber.

5. The air conditioner according to claim 1, wherein the connecting channel is located outside a periphery of the heat exchanger.

6. The air conditioner according to claim 1, further comprising a front panel which covers the case, wherein the guiding groove is recessed in a direction away from the front panel.

7. The air conditioner according to claim 1, wherein the connecting channel enters a top of the external air inlet chamber.

8. The air conditioner according to claim 1, further comprising a fan which sucks interior air and the external air into the interior of the heat exchanger.

9. An air conditioner, comprising:

a case comprising an external air inlet opening formed in one side of the case, an air intake formed in another side of the case, and an air outlet formed at a side of the air intake to discharge air into an indoor space;

an external air inlet chamber, provided in the case, into which external air enters through the external air inlet opening;

a connecting channel through which external air passes from the external air inlet chamber;

a fan provided within the case and configured to mix external air from the connecting channel with interior air introduced through the air intake; and a heat exchanger disposed at a discharge portion of the fan, wherein mixed external and interior air, mixed in the fan, passes through the heat exchanger and is discharged through the air outlet into the indoor space.

* * * * *